US005295609A

United States Patent [19]

Robbins, III

[11] Patent Number: 5,295,609

[45] Date of Patent: Mar. 22, 1994

[54] CONTAINER WITH INTEGRAL STRAW

[76] Inventor: Edward S. Robbins, III, 459 North Ct., Florence, Ala. 35630

[21] Appl. No.: 51,681

[22] Filed: Apr. 23, 1993

[51] Int. Cl.[5] ..... B65D 47/00

[52] U.S. Cl. ..... 210/710; 215/1 A; 215/229

[58] Field of Search ..... 220/710; 215/1 A, 229

[56] References Cited

U.S. PATENT DOCUMENTS

| | | | |
|---|---|---|---|
| 1,213,961 | 1/1917 | Shepard | 220/710 X |
| 2,599,919 | 6/1952 | Hucknall | 220/710 |
| 2,724,536 | 11/1955 | Pugh, Sr. | 215/1 A X |
| 3,349,987 | 10/1967 | Weitzner | 229/13 |
| 3,398,427 | 8/1968 | John | 222/464 X |
| 3,462,061 | 8/1969 | Shore | 229/7 |
| 3,765,574 | 10/1973 | Urquiza | 222/183 |
| 3,774,804 | 11/1973 | Henning | 220/90.2 |
| 4,586,625 | 5/1986 | Garrett | 220/226 |
| 4,607,755 | 8/1986 | Andreozzi | 215/1 A |
| 4,709,829 | 12/1987 | Johnson et al. | 220/90.2 |
| 4,759,475 | 7/1988 | Munthe | 222/464 |
| 4,811,860 | 3/1989 | Sorenson et al. | 220/380 |
| 4,921,147 | 5/1990 | Poirier | 222/527 |
| 4,982,854 | 1/1991 | Ichimiya | 215/1 A |
| 5,005,717 | 4/1991 | Oilar | 215/13.1 |
| 5,048,705 | 9/1991 | Lynd et al. | 215/1 A |
| 5,054,631 | 10/1991 | Robbins, III | 215/1 A |
| 5,078,286 | 1/1992 | Hashimoto | 215/1 A |
| 5,109,995 | 5/1992 | Lou | 215/1 A |
| 5,221,016 | 6/1993 | Karpal | 215/229 X |

*Primary Examiner*—Steven M. Pollard
*Attorney, Agent, or Firm*—Nixon & Vanderhye

[57] ABSTRACT

A flexible plastic bottle or container includes a body portion having a peripheral side wall having a cross section with a regular polygon shape, a bottom wall and a top wall; a fill opening in the top wall; a closure removably securable over the fill opening; an integral straw portion formed in the body portion and extending above the top wall, the straw having a dispensing opening at an upper end thereof; and a straw cap attached to the closure for engaging and closing the dispensing opening of the integral straw portion.

20 Claims, 4 Drawing Sheets

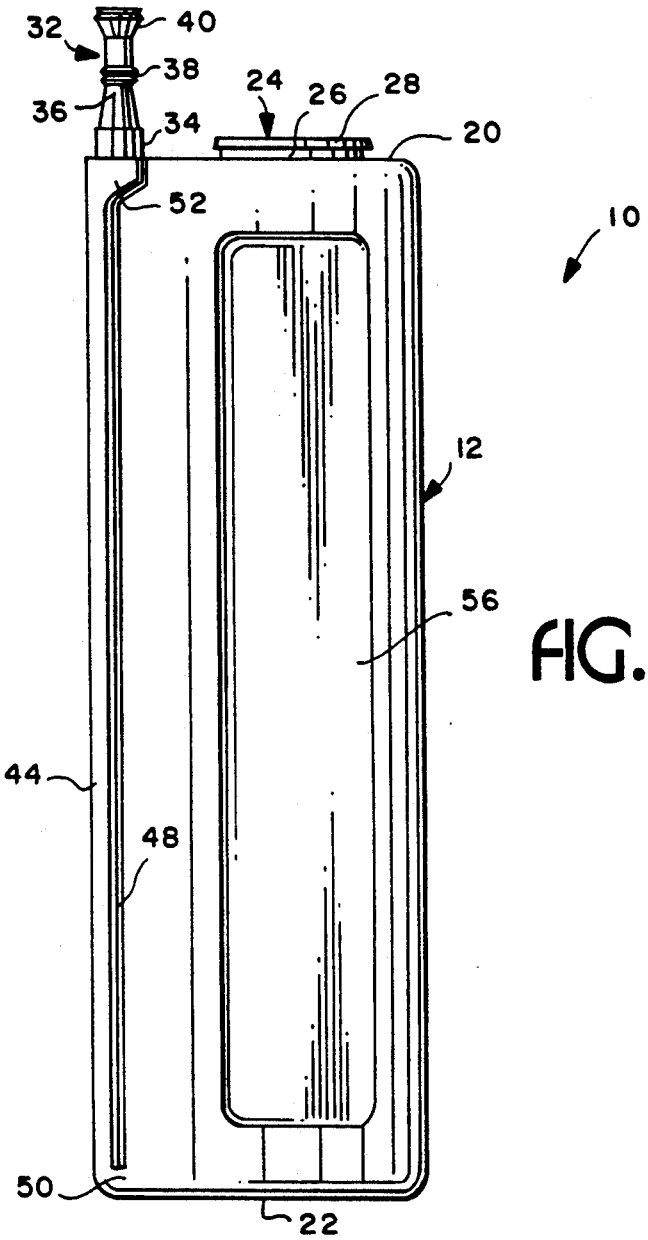
FIG. 2
FIG. 3
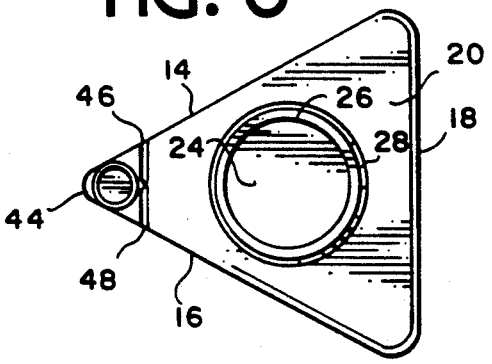
FIG. 4
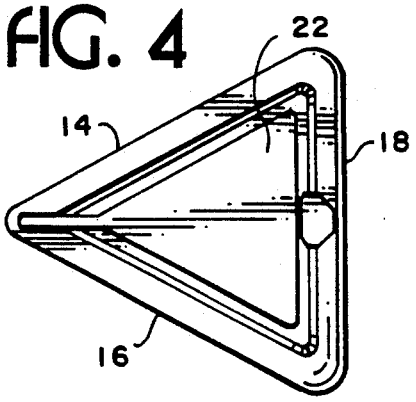

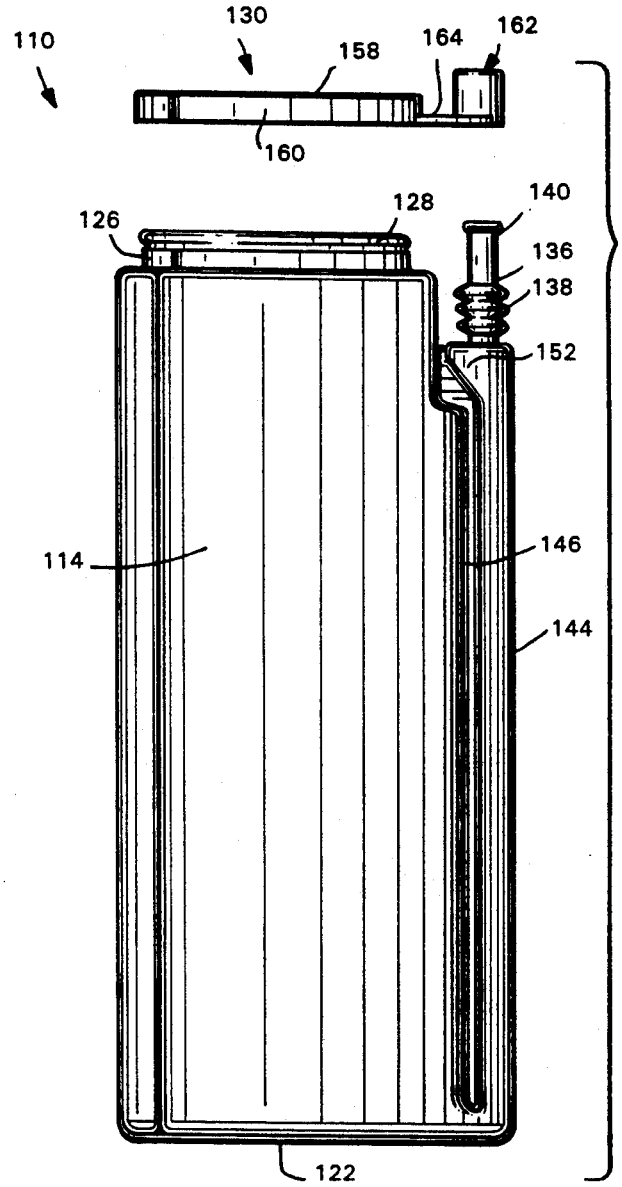
FIG. 7
FIG. 8
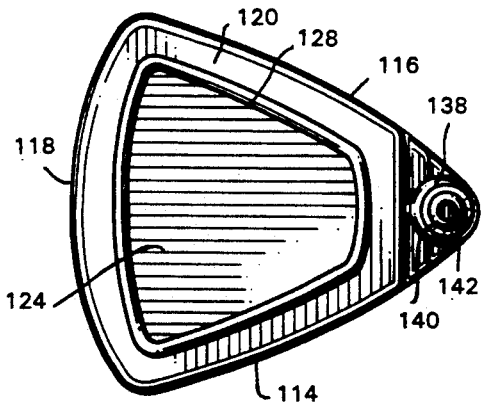

CONTAINER WITH INTEGRAL STRAW

BACKGROUND AND SUMMARY OF THE INVENTION

This invention relates generally to plastic containers and, specifically, to a unique flexible plastic bottle construction, particularly adapted for use as a so-called "sports bottle" which incorporates an integral straw to facilitate sipping and/or squeezing of the liquid contents (typically water or juice) from the bottle or container.

Plastic containers with attached straw members are generally known in the art. Representative examples found in the patent literature include U.S. Pat. No. 5,078,286 which discloses a cube-shaped soft drink container made of thin, soft synthetic resin with a longitudinal cut-out portion in one corner of the body, and a straw member coextensively disposed in the cut-out portion. One end of the straw member is attached to a lower end of the container body and the straw member includes a bellows formed in an intermediate portion which enables the straw to be pulled upwardly to a level above a top wall of the container. A retractable fluid infusion or filling nozzle is provided in the bottom wall of the container.

In applicant's own prior U.S. Pat. No. 5,054,631, a one-piece plastic container is disclosed which includes an integral straw extending upwardly from the top portion of the container. Various embodiments are disclosed which enable the straw to be bent or folded to an out of the way position when not in use.

In U.S. Pat. No. 4,982,854, a beverage container is disclosed which is made of synthetic resin and which has a beverage pouring inlet in the container bottom wall. The container is also provided with a sipping tube whose bottom end is connected to the bottom section of the container, and which extends upwardly along a longitudinal groove in the container body. The sipping tube is provided with a bellows in a middle portion thereof, permitting the sipping tube to be bent within the longitudinal groove which extends from one side of the container body across the center of the top and partially down the other side of the container body.

In U.S. Pat. No. 4,709,829, a beverage container is disclosed which incorporates its own separate straw member.

In U.S. Pat. No. 4,607,755, a children's drinking vessel is disclosed in which a tube 22 is secured to the inside wall of the container. The uppermost end of the tube extends above the lip of the container and is adapted for receiving a flexible drinking straw.

In U.S. Pat. No. 3,462,061, there is disclosed a thin walled self-supporting container formed of plastic film or sheet. The body of the container is of generally tubular form and is generally polygonal in cross section. The intersections of the generally polygonal side walls are provided with external tubes to provide rigidity for the upright body portion. One of the external tubes is adapted to function as an integral straw.

In U.S. Pat. No. 3,349,987, there is disclosed a cylindrical container where opposite sides of the container body are extended upwardly to define two integral tubes which are sealed at their upper ends so as to serve as a carrying handle. The handle may be broken to provide suction tubes or straws on either side of the container, each communicating with a separately sealed chamber within the container.

While it is thus apparent that many attempts have been made to provide containers with integral straws, these efforts, to the best of applicant's knowledge, have not met with any degree of commercial success. This is particularly true with respect to containers which are intended to be reused, i.e., not thrown away after a single use. In a reusable container, it is desirable that the container itself have some convenient means for refilling, and that the integral straw be resealable. In addition, it is important for shipping efficiency that the integral straw not interfere with the usual multi-container nesting arrangements.

It is therefore an object of the present invention to overcome problems extant in the prior art containers by providing a plastic container with an integral, resealable straw. In accordance with a first exemplary embodiment of the invention, a blow-molded plastic container is formed with a triangular cross section so that the container body has three peripheral side walls along with top and bottom walls. The top wall is provided with a relatively large fill or refill opening which may be closed by a snap-on type closure.

In one of the three corners of the container body, an integral straw is formed by pinching opposed peripheral side wall portions together to form a passageway (i.e., an internal straw portion) extending from the top wall to a location just above the bottom wall of the container. A second relatively small opening is provided in the top wall opening into the internal straw passageway and this second opening merges with an integral upper or external straw portion which can be designed if desired to be pushed into the internal straw portion when not in use.

It is another feature of this invention that the snap-on type bottle closure also have a hinged straw cap formed therewith, the straw cap being joined to the larger snap-on closure by a "living", i.e., integral hinge. The arrangement in such that the straw cap may be pivoted downwardly over the upper open end of the external straw portion, in sealing engagement therewith.

The upper or external straw portion may also be provided with a bellows arrangement intermediate its ends to enhance the extension/retraction movements of the straw portion, and to allow essentially universal bending to facilitate sipping.

It is another feature of the invention that the integral straw not interfere to any great extent with the overall external cross section of the container, i.e., the integral straw is formed entirely within the boundaries of the container cross-sectional shape (when viewed in plan) so as not to interfere with stacking.

Thus, in its broader aspects, the present invention provides a plastic container comprising a body portion having a peripheral side wall having a cross section with a regular polygon shape, a bottom wall and a top wall; a fill opening in the top wall; a closure removably securable over the fill opening; an integral straw formed in the body portion and including an internal poriotn and an external upper portion extending above the top wall, the external portion having a dispensing opening at an upper end thereof; and a straw cap attached to the closure for engaging and closing the dispensing opening of external upper portion of the straw.

In another aspect, the invention relates to a plastic, drink dispensing container comprising a body portion having a peripheral side wall having a cross section of regular polygonal shape, and including at least three side wall portions, a bottom wall and a top wall; a fill opening in the top wall; a closure removably securable over said fill opening; and an internal integral straw extending substantially between the top and bottom walls, the straw configured and arranged not to disturb the regular polygonal cross sectional shape of the peripheral side wall.

In still another aspect, the invention relates to a process for forming a container containing an integral straw comprising steps of:

a) providing a substantially cylindrical parison having a closed lower end and an open upper end;

b) blow molding the parison within a closed mold cavity to form a container body having at least three peripheral side wall portions, a bottom wall, and a top wall with a pair of openings therein;

wherein during step b), opposed portions of adjacent side wall portions are pinched together to form an internal straw passageway extending substantially the entire length of the container body while leaving a relatively small portion unpinched to permit communication between the internal straw passageway and a main container body portion.

Additional objects and advantages will become apparent from the detailed description which follows.

BRIEF DESCRIPTION OF THE DRAWINGS

FIG. 2 is a side elevation of the container illustrated in FIG. 1 with the closure removed;

FIG. 3 is a top plan view of the container illustrated in FIG. 2;

FIG. 4 is a bottom plan view of the container illustrated in FIG. 2;

FIG. 7 is a side elevation of a container in accordance with a second and preferred embodiment of the invention; and FIG. 8 is a plan view of the container illustrated in FIG. 7, with the closure removed.

DETAILED DESCRIPTION OF THE DRAWINGS

Figure 1:
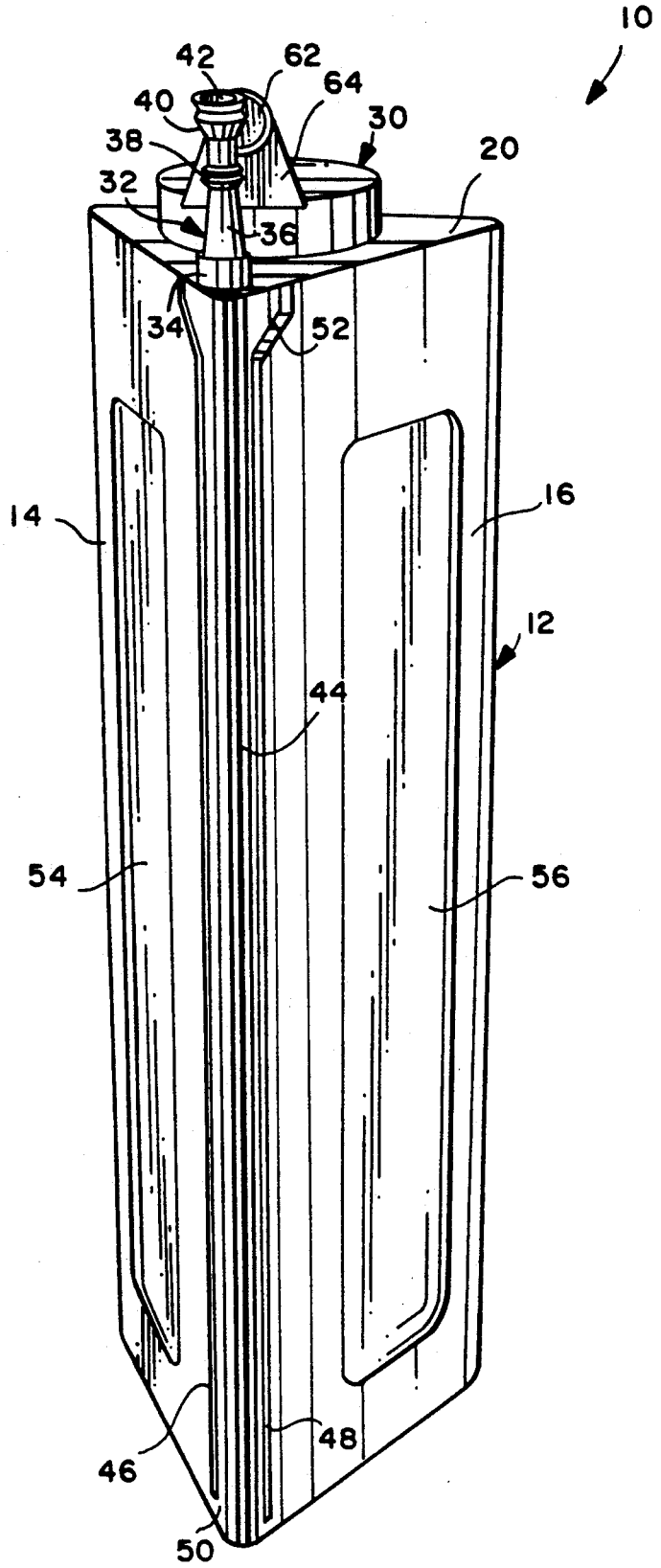
FIG. 1 is a perspective view of a container in accordance with a first exemplary embodiment of the invention.

With reference to FIGS. 1–4, the plastic container 10 (preferably Lucite, but other plastics are also suitable) includes a container body 12 formed with a triangular cross section to thereby provide three peripheral side walls 14, 16 and 18. Other cross-sectional shapes, but preferably regular polygon shapes, may be employed as well. The container also includes a top wall 20 and a bottom wall 22. The top wall 20 is provided with a relatively large opening 24 as defined by an annular upstanding neck 26 formed with one (i.e., continuous) or more circumferential, radially outwardly extending flanges or lugs 28 which enable a snap-on type closure as shown at 30 (see FIGS. 5 and 6) to be applied to the container to close the opening 24.

The top wall 20 is also provided with an upstanding external straw portion 32 located in a corner where the side walls 14 and 16 merge. The external straw portion 32 includes a relatively rigid base portion 34 surrounding a circular aperture (unnumbered) in the top wall 20, a relatively flexible intermediate portion 36 which may incorporate a bellows 38, and an upper discharge portion 40 including a discharge opening 42 in vertical alignment with the unnumbered aperture in the top wall 20. An internal straw portion 44 extending substantially the entire length of the container body 12, is formed during blow molding by pinching together opposed portions of the side walls 14 and 16 to thus form longitudinally extending external grooves or creases 46, 48 which engage each other internally along the entire length of the pinched off portion. As a result, the internal passageway or internal straw portion 44 is formed extending from the top wall 20 (where it communicates with the external straw portion) substantially entirely to the bottom wall 22 with the exception of a small space (indicated by reference numeral 50) which allows the internal straw portion 44 to communicate with the main body portion of the container. This arrangement insures that all of the contents of the container can be discharged easily by sucking through the straw and/or squeezing the flexible side walls of the container.

At the interface between the lower or internal portion of the straw 44 and the upper or external straw portion 36, the internal straw portion is widened (as indicated by reference numeral 52) to establish good communication with the annular base 34 of the upper straw portion.

The container side walls 14 and 16 may also provided with elongated recessed areas 54 and 56 which, in effect, provide handle areas by which the container can be manipulated easily. In addition, the recessed handle areas impart some additional degree of rigidity to the container side walls, but without significantly impacting on the "squeezeablity" of the container.

The closure 30 includes a top wall 58 and an annular peripheral skirt portion 60, the interior of the skirt portion provided with one or more lugs (not shown) which cooperate with the one or more flanges or lugs 28 on the upstanding neck 26 of the container in a conventional manner. The container closure 30 is also formed with a straw cap 62 which is attached to the closure 30 by a connecting web 64 which, in turn, is joined to the closure 30 along a thin, integral "living" hinge 66 which permits the straw cap to be pivoted into and out of engagement with the straw as described below, without danger of losing the cap.

Figure 5:
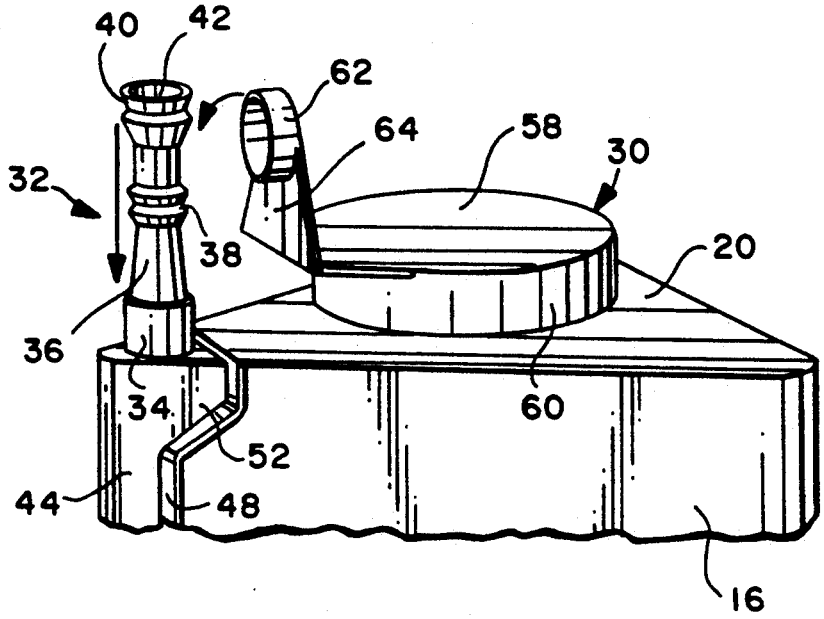
FIG. 5 is a partial but enlarged perspective view illustrating the straw member in an extended in-use position and with the closure in place.
Figure 6:
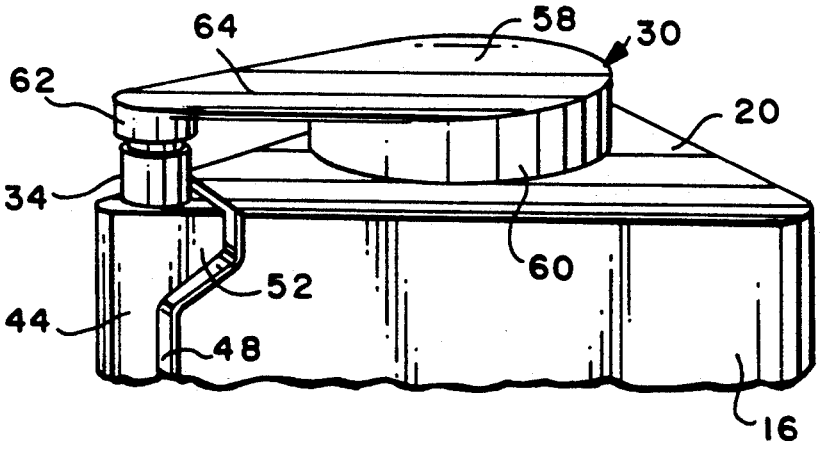
FIG. 6 is a partial but enlarged perspective view similar to claim 5 but illustrating the straw member in a retracted position and sealed with a straw cap of the closure.

The external straw portion 32 may be a separate member which can be pushed, i.e., telescoped, into the internal straw portion, via base portion 34, in order to permit the straw cap 62 to be applied over the discharge opening 42 as best seen in FIGS. 5 and 6. Thus, pushing the upper or external straw portion 32 down into the internal straw portion 44 of the container will enable the straw cap 62 to be pivoted down into sealing engagement with the discharge aperture 42. Similarly, in order to open the container, after the straw cap 62 is pivoted away from the upper straw portion 32, the latter may be pulled up and out of the container to the position illustrated in FIG. 5. As already indicated, the external or upper straw portion 32 may incorporate a bellows 38 to render the uppermost portion universally flexible, and thereby facilitate sipping from any direction. It will be appreciated that the external straw portion 32 may be an integral part of the blow molded container body, with the thickness of the external straw portion chosen to permit a collapsing action to the position illustrated in FIG. 5.

Turning now to FIGS. 7 and 8, and alternative and preferred embodiment of the invention is shown. In this embodiment, (where reference numerals similar to those used in FIGS. 1-6, but with the prefix "1", are used to designate common components) the overall cross-sectional shape, and specifically the shape of side walls 114, 116 and 118, of the container have been slightly rounded from the triangular shape illustrated in FIGS. 1-6. In addition, the non-expendable/retractable upper portion of the container has been modified so that the internal straw portion terminates below the top wall 120 of the container. In this way, the upper or external straw portion 132 is more closely oriented to the container closure 130 and straw cap 62. Thus, the upper straw portion 132 need not be collapsible into the internal portion 144 of the straw as in the previously described embodiment. Nevertheless, the upper portion 132 of the straw may incorporate a bellows section 138, again enabling the straw to be bent in any direction to facilitate sipping.

While the invention has been described in connection with that is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A plastic container comprising:

a body portion having a peripheral side wall having a cross section with a regular polygon shape, a bottom wall and a top wall;

a fill opening in said top wall;

a closure removably securable over said fill opening;

an integral straw formed in said body portion and including an internal portion and an external upper portion extending above said top wall, said external portion having a dispensing opening at an upper end thereof; and a straw cap attached to said closure for engaging and closing said dispensing opening of said external upper portion of the straw.

2. The container of claim 1 wherein said fill opening has a first diameter and said dispensing opening has a second diameter smaller than said first diameter.

3. The container of claim 1 wherein said closure is a snap-on closure.

4. The container of claim 1 wherein said straw cap is pivotally secured to said closure by means of an integral hinge.

5. The container of claim 1 wherein that portion of said integral straw which extends above said top wall is retractable into a remaining portion of said straw within said body portion.

6. The container of claim 1 wherein said body portion is triangular in cross section.

7. The container of claim 6 wherein said integral straw is formed at an intersection of two of said three side wall portions.

8. The container of claim 7 wherein said integral straw lies wholly within said triangular cross section.

9. The container of claim 8 wherein said fill opening has a first diameter and said dispensing opening has a second diameter smaller than said first diameter, and wherein said straw cap is pivotally secured to said fill closure.

10. A plastic, drink dispensing container comprising:

a body portion having a peripheral side wall having a cross section of regular polygonal shape, and including at least three side wall portions, a bottom wall and a top wall;

a fill opening in said top wall;

a closure removably securable over said fill opening; and an internal, integral straw extending substantially between said top and bottom walls, said straw configured and arranged not to disturb said regular polygonal cross sectional shape of said peripheral side wall.

11. The container of claim 10 wherein said body portion has a substantially triangular cross section including three side wall portions, and said internal integral straw is formed within an internal corner thereof.

12. The container of claim 11 wherein said integral straw is formed substantially entirely by material from two of said three side wall portions.

13. The container of claim 12 wherein said two of said three side wall portions are pinched together adjacent said internal corner to form said internal integral straw.

14. The container of claim 13 wherein said two of said three side wall portions are pinched together from said top wall to a location spaced from but proximate to said bottom wall.

15. The container of claim 14 wherein said internal integral straw includes a bendable portion external of the container.

16. The container of claim 10 wherein said internal integral straw is formed substantially entirely by material from two of said at least three side wall portions.

17. The container of claim 16 wherein said two of said at least three side wall portions are pinched together adjacent an intersection of said two side wall portions to form said internal integral straw.

18. The container of claim 17 wherein said two side wall portions are pinched together from said top wall to a location spaced form but proximate to said bottom wall.

19. The container according to claim 18 wherein said internal integral straw includes a bendable portion external of the container.

20. A plastic container comprising;

a body portion including a top wall, a bottom wall and a peripheral side wall defining an interior volumetric space;

a fill opening in said top wall;

an integral straw having an upper open end extending above said top wall and a lower end in communication with a lower portion of said interior volumetric space adjacent said bottom wall, said integral straw having an expendable portion including said upper open end; and a combined closure having a first cap for closing said fill opening and a second cap for closing said upper open end of said integral straw.

* * * * *